United States Patent [19]

Arai et al.

[11] 4,283,356

[45] Aug. 11, 1981

[54] CARBURETOR FOR INTERNAL COMBUSTION ENGINES

[75] Inventors: Hisaharu Arai, Nagoya; Kunio Kadowaki, Oobu, both of Japan

[73] Assignee: Aisan Industry Co., Ltd., Ohbu, Japan

[21] Appl. No.: 34,669

[22] Filed: Apr. 30, 1979

[30] Foreign Application Priority Data

May 16, 1978 [JP] Japan ..... 53-57855

[51] Int. Cl.[3] ..... F02M 5/08

[52] U.S. Cl. ..... 261/72 R; 261/DIG. 67; 123/519

[58] Field of Search ..... 261/DIG. 67, 72 R; 123/519

[56] References Cited

U.S. PATENT DOCUMENTS

| | | | |
|---|---|---|---|
| 2,568,987 | 9/1951 | Brunner | 261/41 D |
| 3,273,871 | 9/1966 | Winkler | 261/DIG. 67 |
| 3,548,797 | 12/1970 | Higihara et al. | 261/DIG. 67 |
| 3,618,581 | 11/1971 | Simonet | 261/DIG. 74 |
| 3,852,381 | 12/1974 | Mick | 261/DIG. 67 |
| 4,058,978 | 11/1977 | Bockelmann | 261/121 B |
| 4,062,910 | 12/1977 | Rogerson et al. | 261/DIG. 67 |
| 4,124,662 | 11/1978 | Morita | 261/41 D |
| 4,157,366 | 6/1979 | Ruth et al. | 261/DIG. 67 |

FOREIGN PATENT DOCUMENTS

| | | | |
|---|---|---|---|
| 1280617 | 10/1968 | Fed. Rep. of Germany | 261/DIG. 67 |
| 2034968 | 6/1971 | Fed. Rep. of Germany | 261/DIG. 67 |
| 611796 | 10/1960 | Italy | 261/DIG. 67 |
| 1020440 | 2/1966 | United Kingdom | 261/DIG. 67 |

*Primary Examiner*—Tim R. Miles

*Attorney, Agent, or Firm*—Cushman, Darby & Cushman

[57] ABSTRACT

A carburetor for internal combustion engines includes an inner vent passage through which the space on the free surface of liquid fuel in a float chamber is communicated with the intake passage of the carburetor and an outer vent passage through which the space in the float chamber is communicated with a charcoal canister adapted to store the fuel vapor coming from the space in the float chamber. A valve is movable between a first position in which the inner vent passage is closed and the outer vent passage is opened and a second position in which the inner vent passage is opened and the outer vent passage is closed. A pressure responsive valve actuator is operative in response to the vacuum in the intake passage to normally bias the valve to the first position and to move the valve to the second position when a vacuum is established in the intake passage. A further valve is diposed to control the connection and disconnection between the pressure responsive valve actuator and the intake passage. The further valve interrupts, when the throttle valve reaches a predetermined opening degree, the communication of the valve actuator and the intake passage so as to maintain the valve actuator in the state in which it is subjected to the vacuum which has been derived from the intake passage, thereby to retain the first-mentioned valve in the second position.

5 Claims, 1 Drawing Figure

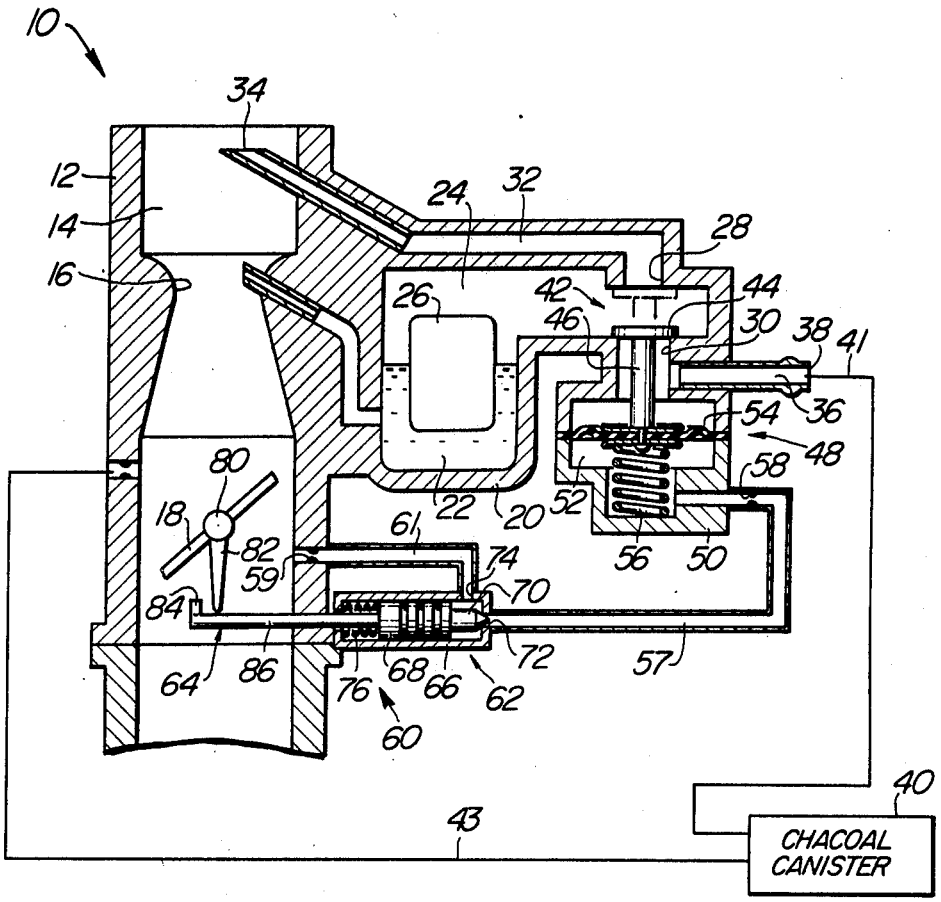
10
34
12
14
16
24
32
28
26
42
44
46
30
38
41
36
54
48
58
80
18
82
59
22
20
52
61
74
70
56
50
84
64
86
68
66
72
57
76
62
60
40
43
CHACOAL
CANISTER

CARBURETOR FOR INTERNAL COMBUSTION ENGINES

BACKGROUND OF THE INVENTION

1. Field of the Invention

The present invention relates to a carburetor for internal combustion engines and, more particularly, to a carburetor in which the flow of the vapor evaporated from a liquid fuel in the float chamber is suitably controlled to prevent loss of fuel and environmental contamination.

2. Description of the Prior Art

A typical conventional carburetor for internal combustion engines, which is designed to control the flow of fuel vapor filling the space on the free surface of liquid fuel in float chamber, includes an inner vent passage through which the space in the float chamber is communicated with the intake passage of the carburetor, an outer vent passage through which the sapce in the float chamber is communicated with a vessel for storing the fuel vapor such as a charcoal canister, and a solenoid valve adapted to open and close the outer vent passage as its coil is energized and de-energized in accordance with the operation of engine ignition key. In this conventional carburetor, since the inner vent passage is always opened, a part of the fuel vapor is inconveniently relieved or discharged to the intake passage during the engine-off period, resulting in a contamination of the air cleaner and starting failure of the engine. In addition, it is impossible to absorb all of the fuel vapor in the charcoal canister during the engine-off period, because a considerable part of the evaporated fuel is relieved to the intake passage.

To avoid such drawbacks, there has been proposed a carburetor having a valve adapted to operate in response to the vacuum in the intake passage, in such a manner that it normally closes and opens the inner and outer vent passages, respectively, and opens and closes the inner and outer vent passages, respectively, when a vacuum is generated in the intake passage. In this carburetor, however, the inner and outer vent passages are inconveniently closed and opened, respectively, when the vacuum in the intake passage has become low during running operation of engine so that the function of the inner vent passage is failed.

SUMMARY OF THE INVENTION

It is therefore a major object of the invention to provide a carburetor which can ensure the opening of the inner vent passage and closing of the outer vent passage during running of the engine irrespective of the engine speed and the level of the load applied to the engine.

To this end, according to the invention, there is provided a carburetor for internal combustion engines, comprising: a carburetor body having therein an intake passage and a float chamber, the float chamber receiving therein a liquid fuel with a space left on the free surface of the fuel; a throttle valve within the intake passage for opening and closing the same; a first vent passage having one end thereof opening to the intake passage and the other end communicating with the space within the float chamber; a second vent passage having one end thereof communicating with the space within the float chamber and the other end adapted to communicate with a container for receiving therein fuel vapor from the space within the float chamber; valve means movable between a first position in which the first vent passage is closed and the second vent passage is opened and a second position in which the first vent passage is opened and the second vent passage is closed; means for generating pressure signals in accordance with the conditions of the engine operation; first actuating means operative in response to the pressure signals from the signal generating means to normally cause the valve means to move into the first position and to cause the valve means to move into the second position during the engine running operation; and control means operative in response to the opening and closing movements of said throttle valve for controlling said actuating means so as to cause the same to retain said valve means in said second position when said throttle valve reaches a predetermined opening degree.

BRIEF DESCRIPTION OF THE DRAWING

The single drawing is a schematic sectional view of a carburetor embodying the present invention.

DESCRIPTION OF THE PREFERRED EMBODIMENTS

Referring to the drawings, a carburetor embodying the invention is generally designated at a reference numeral 10. The carburetor 10 has a carburetor body 12 having therein an intake passage 14 through which an air cleaner (not shown) is communicated with an intake manifold (not shown). The intake passage 14 is provided with a venturi 16. A pivotable throttle valve 18 is disposed in the intake passage 14 at the downstream side of the venturi 16.

The carburetor body 12 is provided therein with a float chamber 20 which receives a liquid fuel 22 with a space left on the free surface 24 of the liquid fuel. The space 24 is filled with fuel vapor evaporated from the liquid fuel. A float 26 disposed in the float chamber 20 is adapted to deliver a signal concerning the fuel level to a fuel meter which is not shown. A pair of ports 28, 30 are formed in the wall of the float chamber 20. These ports 28, 30 are spaced from and opposed to each other, and opens to the space 24 in the float chamber 20.

An inner vent passage 32 has one end 34 opening in the intake passage 14 at the upstream side of the venturi 16, and the other end communicating with the upper one of the pair of ports 28 so as to provide a communication between the intake passage 14 and the space 24 in the float chamber 20. An outer vent passage 36 has one end communicating with the lower one of the pair of ports 30 and the other end 38 which is in communication with, through a conduit 41, a container containing an absorbent such as activated charcoal for adsorbing and storing the fuel vapor, such as a charcoal canister 40, so as to make the charcoal canister 40 and the space 24 in the float chamber communicate with each other. The charcoal canister 40 is in communication with the intake passage 14, through a conduit 43.

A valve generally denoted by a numeral 42 is associated with the aforementioned pair of ports 28, 30. The valve 42 is adapted to move between a first position shown by imaginary lines in which the upper and lower ports 28, 30 are closed and opened, respectively, and a second position shown by the solid lines in which the upper and lower ports 28, 30 are opened and closed, respectively. The valve 42 has a valve head 44 movable between the pair of ports 28, 30 and a valve stem 46 which is connected at one end to the valve head 44 and extending through the lower port 30 coaxially with the latter.

A first valve actuator 48 is associated with the valve 42 for actuating the same in response to a pressure signal. The first valve actuator 48 includes a housing 50 and a diaphragm 54 disposed within the housing 50 to define a pressure chamber 52 in the housing 50. The aforementioned valve stem 46 is connected at its other end to the diaphragm 54. A spring 56 disposed in the pressure chamber 52 is adapted to normally bias the diaphragm 54 so as to position the valve 42 in a first position in which the valve head 44 closes the upper port 28. The pressure chamber 52 is communicated, through a conduit 57, with the portion of the intake passage 14 downstream of the throttle valve 18, so that the pressure established in that portion of the intake passage 14 is transmitted to the pressure chamber 52. Thus, the intake passage 14 constitutes means for generating a pressure signal for the first valve actuator 48. Restrictions 58, 59 are disposed in the ends of the conduits 57, 61 respectively, to control the pressure of the fluid passing therethrough.

As the throttle valve 18 is opened during running of the engine, a vacuum is generated in the intake passage 14. This vacuum is introduced through the conduits 57, 61 into the pressure chamber 52 of the first valve actuator 48 to deflect the diaphragm 54 overcoming the force of the spring 56. As a result, the valve 42 is moved from the first position shown by imaginary lines in which the valve head 44 closes the upper port 28 and opens the lower port 30, to the second position shown by the solid line in which the valve head 44 opens and closes, respectively, the upper and lower ports 28, 30.

A controller 60 is associated with the conduits 57 and 61, for controlling the communication between these conduits. The controller 60 has a valve 62 adapted to open and close the conduit 57 and a valve actuator 64 adapted for actuating the valve 62. The valve 62 includes a housing 66 fixed to the carburetor body 12, a slider 68 axially movable in the housing in a sealing manner and a valve head 70 connected to the slider 68. The housing 66 has a port 72 formed at one axial end thereof, and another port 74 opening in its side wall. The port 72 is in communication with the conduit 57, while the port 74 is in communication with the conduit 61. A spring 76 disposed in the housing 66 is adapted to bias the slider 68 in the direction to cause the valve head 70 to close the port 72.

The valve actuator 64 for actuating the valve 62 has a lever 82 attached to the valve shaft 80 of the throttle valve 18 for a unitary rotation therewith, and an actuating rod 86 which is bent at its one end 84 and connected at its other end to the slider 68 of the valve 62. The arrangement is such that, when the throttle valve is in its fully-closed position, the lever 82 engages the bent end 84 of the actuating rod 86, so as to move the latter against the force of the spring 76, thereby to permit the valve head 70 to open the port 72.

In operation, the throttle valve 18 is kept closed during the engine-off period, and no vacuum is established in the intake passage 14. Under this normal condition, the lever 82 fixed to the valve shaft 80 of the throttle valve 18 engages the bent end 84 of the actuating rod 86, so that the actuating rod 86 is moved against the force of the spring 76 so as to cause the valve head 70 to clear and open the port 72. Consequently, the pressure chamber 52 of the valve actuator 48 is brought into communication with the intake passage 14, through the conduit 57, ports 72 and 74 and the conduit 61. Since no vacuum is established in the intake passage 14, the diaphragm 54 of the valve actuator 48 is deflected by the force of the spring 56 so as to locate the valve 42 at the first position shown by imaginary lines, in which the valve head 44 closes the upper port 28. As a result, the fuel vapor in the space 24 within the float chamber 20 is introduced through the lower port 30, outer vent passage 36 and a conduit 41, into the charcoal canister 40, thereby to be adsorbed and stored by the charcoal particles in the canister.

Then, as the throttle valve 18 is opened concurrently with the start of the engine, a vacuum is established in the intake passage 14. The vacuum in the intake passage is transmitted to the pressure chamber 52, through the conduit 61, ports 72, 74 and then through the conduit 57, to deflect the diaphragm 54 overcoming the force of the spring 56, thereby to move the valve 42 from the first position shown by imaginary lines to the second position shown by the solid line. In the illustrated second position, the valve head 44 opens the upper port 28 and closes the lower port 30. As a result, the fuel vapor in the space 24 within the float chamber 20 is relieved or discharged into the intake passage 14, through the upper port 28 and the inner vent passage 32. At the same time, the fuel vapor which has been stored in the charcoal canister 40 is induced, through the conduit 43, into the intake passage 14 due to the vacuum generated in the latter, and further into the engine, so that the canister 40 is cleaned. As the throttle valve 18 is opened, the rotation of the lever 82 caused by the opening movement of the throttle valve permits the spring 76 to drive the actuating rod 86 linearly, thereby to move the valve head 70 toward the port 72. As the throttle valve 18 has been opened to a predetermined opening degree, the valve head 70 is seated on the port 72 to close the latter, so that the communication between the pressure chamber 52 and the intake passage 14 is interrupted. As a result, the vacuum which has been derived from the intake passage 14 is confined in the pressure chamber 52, thereby to retain the valve 42 in the second position shown by the solid line. Thus, once the throttle valve is opened to the predetermined opening degree, the valve 42 is never moved back to the first position as shown by imaginary lines, even if the level of vacuum in the intake passage 14 is lowered.

As has been described, in the carburetor of the invention, the controller 60 maintains the valve actuator 48 in the state in which it is subjected to the vacuum which has been derived from the intake passage, irregardless of the engine speed and the level of the load imposed on the engine, after the throttle valve has been opened to a predetermined opening degree, so as to retain the valve 42 in the second position in which it opens the upper port 28 and closes the lower port, so that the function of the inner vent passage 32 is not failed.

Even if the distance between the valve actuator 48 and the pressure signal generator, i.e. the intake passage 14, is somewhat long, it can be covered simply by changing the lengths of the conduits 57 and 61. Namely, the carburetor in accordance with the invention has a larger degree of freedom of design, and hence is easy to manufacture. In addition, since the fuel vapor in the float chamber is introduced into the charcoal canister during the engine-off period, the direct release of the fuel vapor, which would cause a contamination of atmosphere, is fairly avoided. Further, since the fuel vapor in the float chamber is not relieved to the intake passage during the engine-off period, the starting failure attributable to the accumulation of fuel vapor is also obviated.

What we claim is:

1. In a carburetor for an internal combustion engine having an intake passage with a throttle valve therein, a float chamber, a first vent passage extending between the float chamber and the intake passage and a second vent passage communicating between the float chamber and a fuel vapor absorption device wherein the improvement comprises first valve means operable between a first position when no vacuum is applied where the first passage is closed and the second passage is open and a second position when vacuum is applied, respectively, opening and closing the first and second passages, conduit means for operatively connecting said first valve means to said intake passage, second valve means located within said conduit means and operatively connected to said throttle valve for opening said conduit means when said throttle valve is closed and closing said conduit means when the throttle valve is opened to a predetermined degree so that said conduit means and said second valve means provide an open passage between the intake passage and said first valve means when said engine is off and a closed passage after said throttle valve opens a predetermined amount whereby vacuum applied along said conduit means is maintained therein after said second valve closes.

2. A carburetor for internal combustion engines, comprising:

a carburetor body having therein an intake passage and a float chamber, said float chamber receiving therein a liquid fuel with space left on the free surface of the fuel, said float chamber including a pair of opposed and spaced ports opening to said space;

a throttle valve within said intake passage for opening and closing the same;

a first vent passage having one end thereof opening to said intake passage and the other end communicating with one of said pair of ports;

a second vent passage having one end thereof communicating with the other port and the other end adapted to communicate with a container for receiving therein fuel vapor from said space within said float chamber;

first valve means including a single valve head and a valve stem extending in a coaxial relation to said pair of ports and having one end connected to said valve head, said valve head being movable between a first position in which said one port is closed and said the other port is opened and a second position in which said one port is opened and said the other port is closed;

first actuating means for actuating said first valve means, said first actuating means including a housing, a diaphragm within said housing to define therein a pressure chamber, said diaphragm being connected to the other end of said valve stem of said first valve means, and a spring normally biasing said diaphragm to cause said valve stem to position said valve head into said first position;

a conduit having one end thereof communicating with said intake passage and the other end communicating with said pressure chamber for introducing a pressure in said intake passage varying between the substantially atmospheric pressure and a vacuum level, into said pressure chamber;

said diaphragm of said first actuating means being operative in response to the pressure introduced into said pressure chamber through said conduit from said intake passage and acting on said diaphragm to allow said valve stem to move said valve head into said first position when the engine is not operated and to actuate said valve stem to move said valve head into said second position against said spring during the engine running operation;

second valve means associated with said conduit for opening and closing said conduit; and second actuating means for actuating said second valve means including a mechanical linkage, connecting said second valve means to said throttle valve, said second actuating means being operative in response to the opening and closing movements of said throttle valve to actuate said second valve means to open said conduit to allow the pressure in said intake passage to be introduced into said pressure chamber through said conduit until said throttle valve reaches a predetermined opening degreee and to actuate said second valve means to close said conduit to interrupt the communication between said intake passage and said pressure chamber for confining the pressure within said pressure chamber to cause said diaphragm of said first actuating means to retain said valve head of said first valve means in said second position once said throttle valve reaches said predetermined opening degree.

3. A carburetor as claimed in claim 2, wherein said second valve means includes a valve head and a spring normally biasing said valve head of said second valve means toward the position where said valve head of said second valve means closes said conduit, and wherein said mechanical linkage of said second actuating means includes an actuating rod connected to said valve head of said second valve means and a lever connected to said throttle valve for unitary pivotal movement therewith, said lever positioning said actuating rod so as to move said valve head of said second valve means against the force of said spring associated with said valve head of said second valve means to the position where said valve head of said second valve means opens said conduit until said throttle valve is opened from its fully closed position to said predetermined opening degree, and said lever positioning said actuating rod so as to move said valve head of said second valve means to the position where said valve head of said second valve means closes said conduit once said throttle valve reaches said predetermined opening degree.

4. A carburetor for internal combustion engines, comprising:

a carburetor body having therein an intake passage and a float chamber, said float chamber receiving therein a liquid fuel with space left on the free surface of the fuel;

a throttle valve within said intake passage for opening and closing the same;

a first vent passage having one end thereof opening to said intake passage and the other end communicating with said space within said float chamber;

a second vent passage having one end thereof communicating with said space within said float chamber and the other end adapted to communicate with a container for receiving therein fuel vapor from said space within said float chamber;

first valve means movable between a first position in which said first vent passage is closed and said second vent passage is opened and a second position in which said first vent passage is opened and said second vent passage is closed;

actuating means having a pressure chamber for actuating said first valve means;

a conduit having one end thereof communicating with said intake passage and the other end communicating with said pressure chamber for introducing a pressure in said intake passage varying between substantially atmospheric pressure and a vacuum condition into said pressure chamber;

said actuating means being operative in response to the pressure introduced into said pressure chamber through said conduit from said intake passage to actuate said first valve means to cause the same to move into said first position when the engine is not operated and to cause said first valve means to move into said second position during the engine running condition;

second valve means associated with said conduit and operative in response to the opening and closing movements of said throttle valve for opening and closing said conduit, said second valve means being operated to open said conduit to allow the pressure in said intake passage to be introduced into said pressure chamber through said conduit until said throttle valve reaches a predetermined opening degree, and said second valve means being operated to close said conduit to interrupt the communication between said intake passage and said pressure chamber for confining the pressure within said pressure chamber to cause said actuating means to retain said first valve means in second position once said throttle valve reaches said predetermined opening degree, wherein said float chamber further includes a pair of opposed and spaced ports opening to said space, one of said ports being in communication with said the other end of said first vent passage while the other being in communication with said one end of said second vent passage, said first valve means including a valve head movable between said pair of ports, wherein said first valve means further includes a valve stem connected at one end to said valve head and extending through said other port in coaxial relation thereto, and wherein said actuating means includes a housing, a diaphragm disposed in said housing to define in the latter said pressure chamber, said valve stem being connected at its other end to said diaphragm, and a spring biasing said valve head to cause said valve head to close said one port, in which the introduction of the pressure in said intake passage through said conduit into said pressure chamber causes said diaphragm to bias said valve stem against the spring force of said spring to close said the other port, comprising a valve actuator connected to said throttle valve to actuate said second valve means for opening and closing said conduit, wherein said second valve means includes a valve head and a spring normally biasing said valve head of said second valve means toward the position where said valve head of said second valve means closes said conduit, and wherein said valve actuator includes an actuating rod connected to said valve head of said second valve means and a lever connected to said throttle valve for unitary pivotal movement therewith, said lever positioning said actuating rod so as to move said valve head of said second valve means against the force of said spring associated with said valve head of said second valve means to the position where said valve head of said second valve means opens said conduit until said throttle valve is opened from its fully closed position to said predetermined opening degree, and said lever positioning said actuating rod so as to move said valve head of said second valve means to the position where said valve head of said second valve means closes said conduit once said throttle valve reaches said predetermined opening degree.

5. A carburetor as claimed in claim 4, wherein said pressure chamber is communicated with a portion of said intake passage downstream of said throttle valve.

* * * * *